US007454819B2

(12) United States Patent
Wu

(10) Patent No.: US 7,454,819 B2
(45) Date of Patent: Nov. 25, 2008

(54) ZIPPER TAB ASSEMBLY

(75) Inventor: Hong-Ming Wu, Taipei Hsien (TW)

(73) Assignee: Jenn Yaw J. Y. Enterprises Co., Ltd., Taishan Hsiang, Taipei Hsien (TW)

( * ) Notice: Subject to any disclaimer, the term of this patent is extended or adjusted under 35 U.S.C. 154(b) by 256 days.

(21) Appl. No.: 11/556,403

(22) Filed: Nov. 3, 2006

(65) Prior Publication Data

US 2008/0104806 A1 May 8, 2008

(51) Int. Cl.
*A44B 19/26* (2006.01)

(52) U.S. Cl. ..... 24/429

(58) Field of Classification Search ..... None
See application file for complete search history.

(56) References Cited

U.S. PATENT DOCUMENTS 2,145,118 A * 1/1939 Knoess ..... 24/429
2,181,281 A * 11/1939 Morin ..... 40/618
2,185,853 A * 1/1940 Knoess ..... 24/429
4,704,770 A * 11/1987 Minami et al. ..... 24/431
6,082,030 A * 7/2000 Kesselring et al. ..... 40/307
6,314,625 B1 * 11/2001 Ikeda ..... 24/429
7,020,937 B2 * 4/2006 Nakatsuka et al. ..... 24/429
7,213,306 B2 * 5/2007 Medsker ..... 24/429
2005/0005407 A1 * 1/2005 Nakatsuka et al. ..... 24/429

* cited by examiner

*Primary Examiner*—Jack W. Lavinder
(74) *Attorney, Agent, or Firm*—patenttm.us

(57) ABSTRACT

A zipper tab assembly has a connecting member, a clamping member and a decorative tab. The connecting member has a through hole, an engaging channel and two engaging holes. The clamping member is detachably attached to the connecting member and has a resilient loop and two engaging ears. The resilient loop has a clamping space and an opening communicating with the clamping space. The engaging ears are formed on the resilient loop at two sides of the opening and are detachably mounted in the engaging channel in the connecting member. Each engaging ear has a protrusion extending into and engaging with one of the engaging holes in the connecting member. The decorative tab is mounted in and clamped inside the clamping space of the resilient loop.

20 Claims, 13 Drawing Sheets

ZIPPER TAB ASSEMBLY

BACKGROUND OF THE INVENTION

1. Field of the Invention

The present invention relates to a zipper tab assembly, and more particularly to a zipper tab that is changeable and versatile in use.

2. Description of Related Art

With reference to reference to FIG. 13, a conventional zipper tab (90) is connected to a zipper head (50) and comprises a body with a through hole (91) and patterns (92). The through hole (91) is defined through the body and is mounted around a hook (51) formed on the zipper head (50) to connect the tab (90) to the head (50). The patterns (92) are formed on the body to provide a decorative or commercial effect.

However, the conventional zipper tab (90) is always made of metal and is an integral piece and the patterns (92) on the zipper tab (90) is unchangeable, so the conventional zipper tab (90) cannot fit with different needs of different users and is not versatile in use. In addition, the unchangeable patterns (92) on the conventional zipper tab (90) cause the appearance of the tab (90) monotone and unaesthetic.

To overcome the shortcomings, the present invention tends to provide a zipper tab assembly to mitigate or obviate the aforementioned problems.

SUMMARY OF THE INVENTION

The main objective of the invention is to provide a zipper tab assembly that is changeable and versatile in use. The zipper tab assembly has a connecting member, a clamping member and a decorative tab. The connecting member has a through hole, an engaging channel and two engaging holes. The through hole is defined through the connecting member. The engaging channel is defined in the connecting member. The engaging holes are defined in two sides of the connecting member and communicate with the engaging channel. The clamping member is detachably attached to the connecting member and has a resilient loop and two engaging ears. The resilient loop has a clamping space and an opening communicating with the clamping space. The engaging ears are formed on the resilient loop at two sides of the opening and are detachably mounted in the engaging channel in the connecting member. Each engaging ear has a protrusion extending into and engaging with one of the engaging holes in the connecting member. The decorative tab is mounted in and clamped inside the clamping space of the resilient loop.

Other objects, advantages and novel features of the invention will become more apparent from the following detailed description when taken in conjunction with the accompanying drawings.

DETAILED DESCRIPTION OF PREFERRED EMBODIMENT

Figure 1:
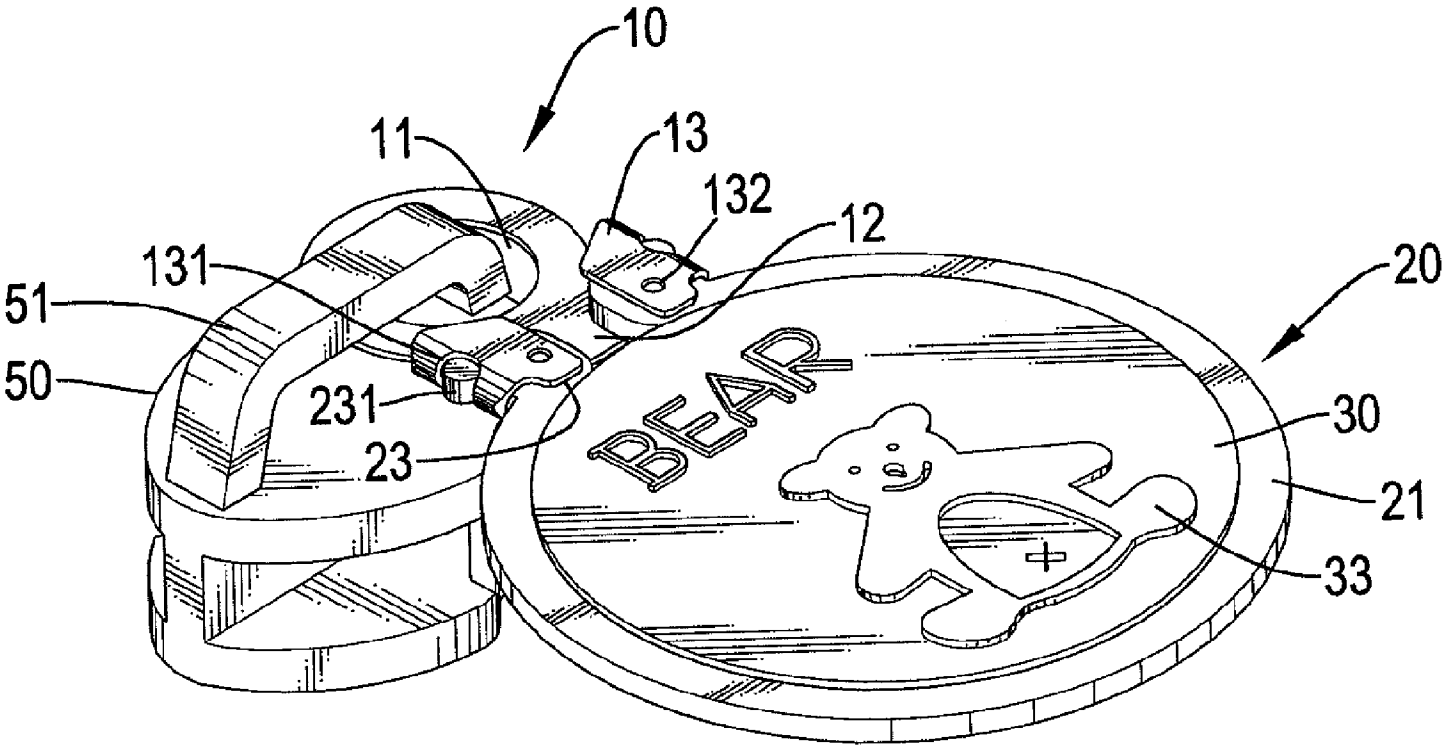
FIG. 1 is a perspective view of a zipper head with a first embodiment of a zipper tab assembly in accordance with the present invention.
Figure 2:
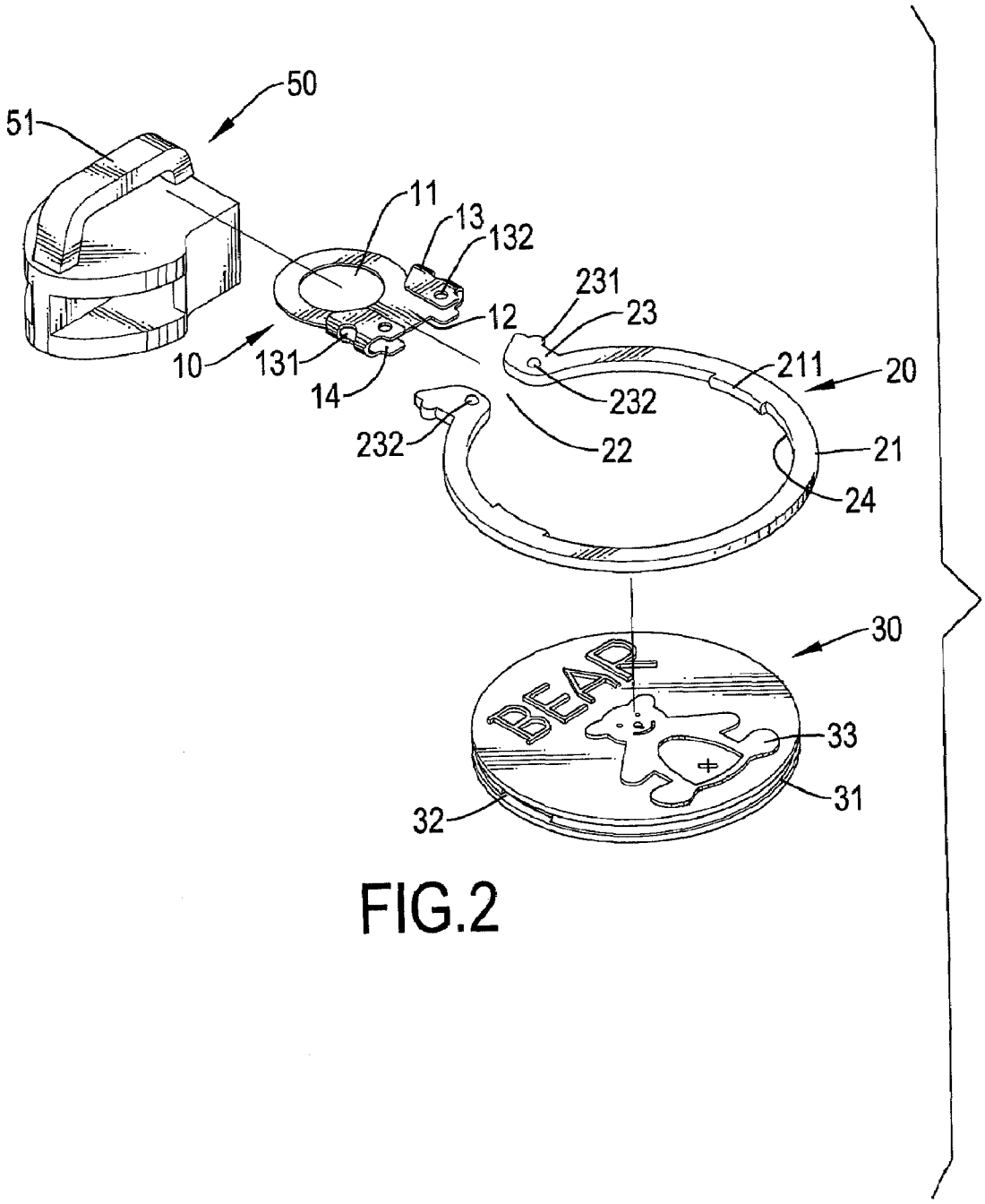
FIG. 2 is an exploded perspective view of the zipper head with the zipper tab assembly in FIG. 1.
Figure 3:
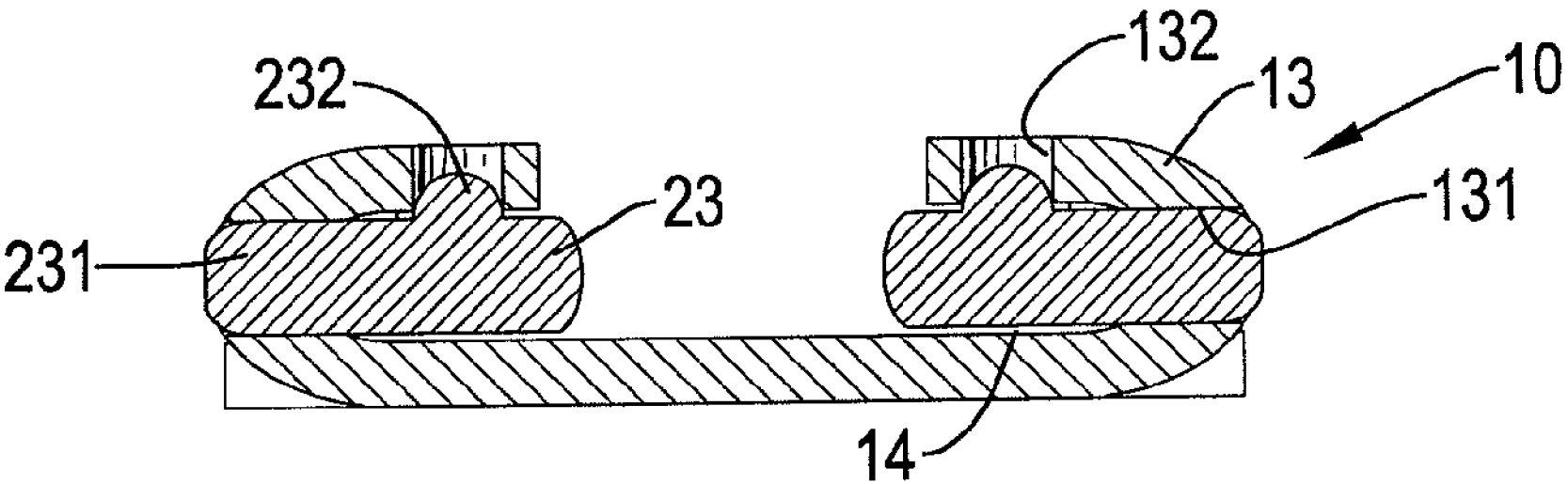
FIG. 3 is a cross sectional side view of the zipper tab assembly in FIG. 1.

With reference to FIGS. 1 to 3, a zipper tab assembly in accordance with the present invention comprises a connecting member (10), a clamping member (20) and a decorative tab (30).

The connecting member (10) is made of metal sheet with a pressing process, is connected to a zipper head (50) and comprises a flat body with a connection portion (12). A through hole (11) is defined through flat body of the connecting member (10) beside the connection portion (12) and is connected with a hook (51) formed on the zipper head (50). The connection portion (12) has two sides, and two U-shaped flanges (13) are formed respectively on two sides of the flat body and correspond to each other to define an engaging channel (14) between the U-shaped flanges (13). Two engaging holes (131) are defined in two sides of the connecting member (10), preferably are defined respectively in the U-shaped flanges (13) and communicate with the engaging channel (14). Each U-shaped flange (13) on the connecting member (10) further has an orifice (132) defined in the top of the flange (13).

The clamping member (20) is detachably attached to the connecting member (10) and may be made of metal or plastic material. The clamping member (20) has a C-shaped resilient loop (21) and has a clamping space (24) and an opening (22) communicating with the clamping space (24). In the first embodiment, the clamping space (24) is circular. At least one lug (211), in the first embodiment, two lugs (211), is formed on and extending inward from an inner surface of the resilient loop (21). Two engaging ears (23) are formed on the resilient loop (21) at two sides of the opening (22) and are detachably mounted in the engaging channel (140) in the connecting member (10). Each engaging ear (23) has a protrusion (231) extending into and engaging with one of the engaging holes (131) in the connecting member (10). In the first embodiment, the protrusions (231) on the engaging ears (23) of the clamping member (20) are convex protrusions (231). In addition, each engaging ear (231) has a knob (232) formed on the top of the engaging ear (23) and engaging with the orifice (132) in a corresponding one of the U-shaped flanges (13).

The decorative tab (30) is mounted in and clamped inside the clamping space (24) of the resilient loop (21) and has a shape corresponding to that of the clamping space (24). The decorative tab (30) can be made of metal, plastic or composite material and can comprise an audio or illuminating device mounted thereon. An annular groove (31) is defined around the decorative tab (30) and engages with the resilient loop (21) of the clamping member (20). With the engagement between the groove (31) and the resilient loop (21), the decorative tab (30) is securely held and clamped inside the clamping space (24) in the resilient loop (21). Additionally, at least one recess (32), in the first embodiment, two recesses (32), is defined in a periphery of the decorative tab (30) and engages respectively with the at least one lug (211) on the resilient loop (21). With the engagement of the lugs (211) and recesses (32), the combination of the decorative tab (30) and the resilient loop (21) is improved. The decorative tab (30) has at least one pattern (33) formed on the decorative tab (30), and the patterns (33) may be words or figures to provide a decorative or commercial effect.

In such an arrangement, a decorative tab (30) with specific patterns can be securely held in the clamping space (24) in the resilient loop (21), and the clamping member (20) is detachably attached to the connecting member (10) with the engaging ears (232) being inserted into the engaging channel (14). With the engagements between the engaging holes (131) with the protrusions (231) and the orifices (132) with the knobs (232), the clamping member (20) with the decorative tab (30) is attached to the connecting member (10). Accordingly, a zipper tab with specific patterns (33) is provided to a zipper head (50). Because the decorative tab (30) is detachably clamped in the resilient loop (21) and is changeable, multiple zipper tabs with different patterns (33) can be provided by means of changing decorative tabs (30) with different patterns (33). Thus, the zipper tab assembly in accordance with the present invention provides variable appearances and is versatile in use.

Figure 4:
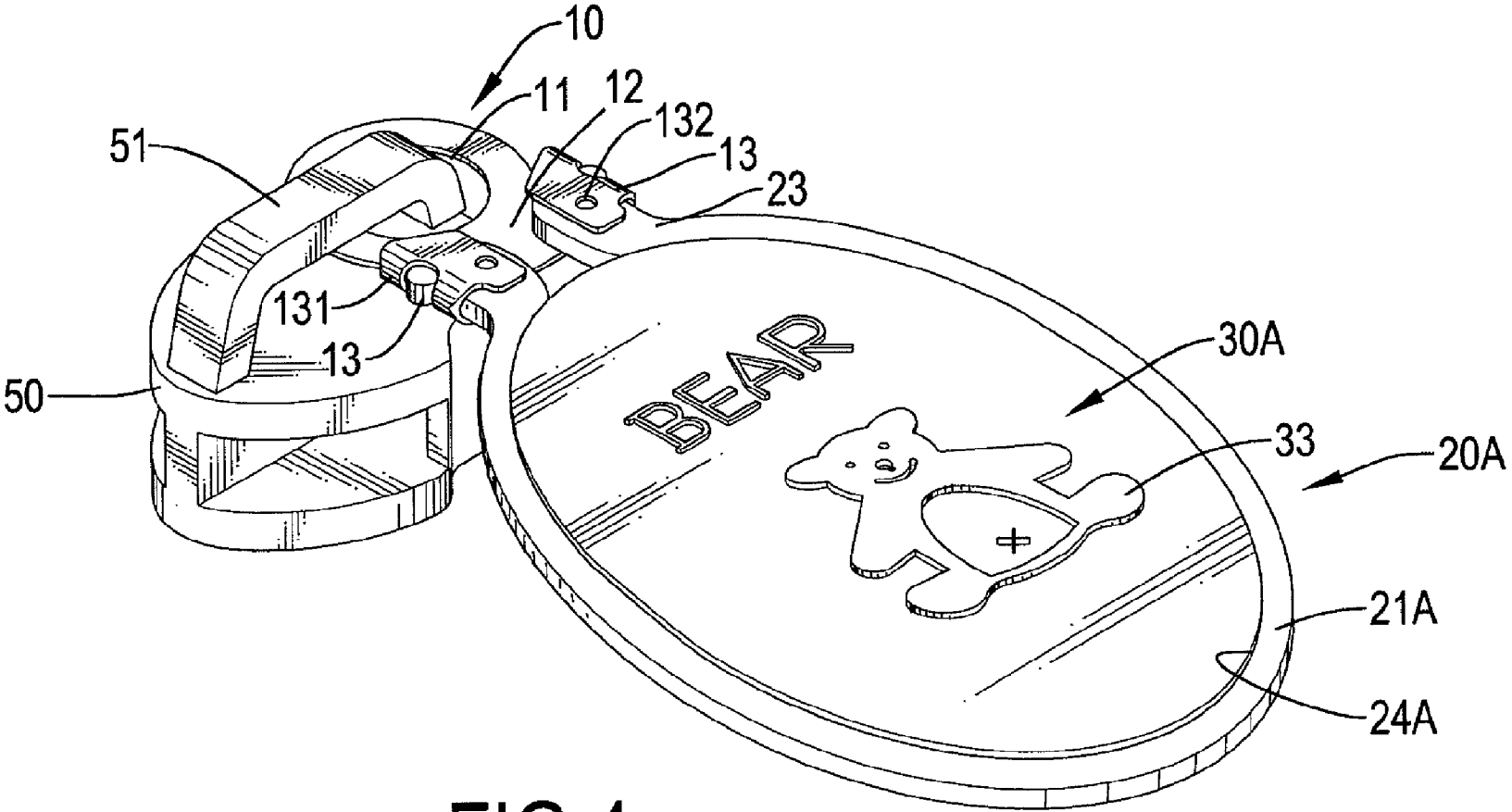
FIG. 4 is a perspective view of a zipper head with a second embodiment of a zipper tab assembly in accordance with the present invention.

With reference to FIG. 4, the clamping space (24A) in the resilient loop (21A) of the clamping member (20A) and the decorative tab (30A) are elliptical. In alternative embodiments, the clamping space of the resilient loop and the decorative tab may be quadrilateral, polygonal or any possible shape to make the shape of the zipper tab assembly various.

Figure 5:
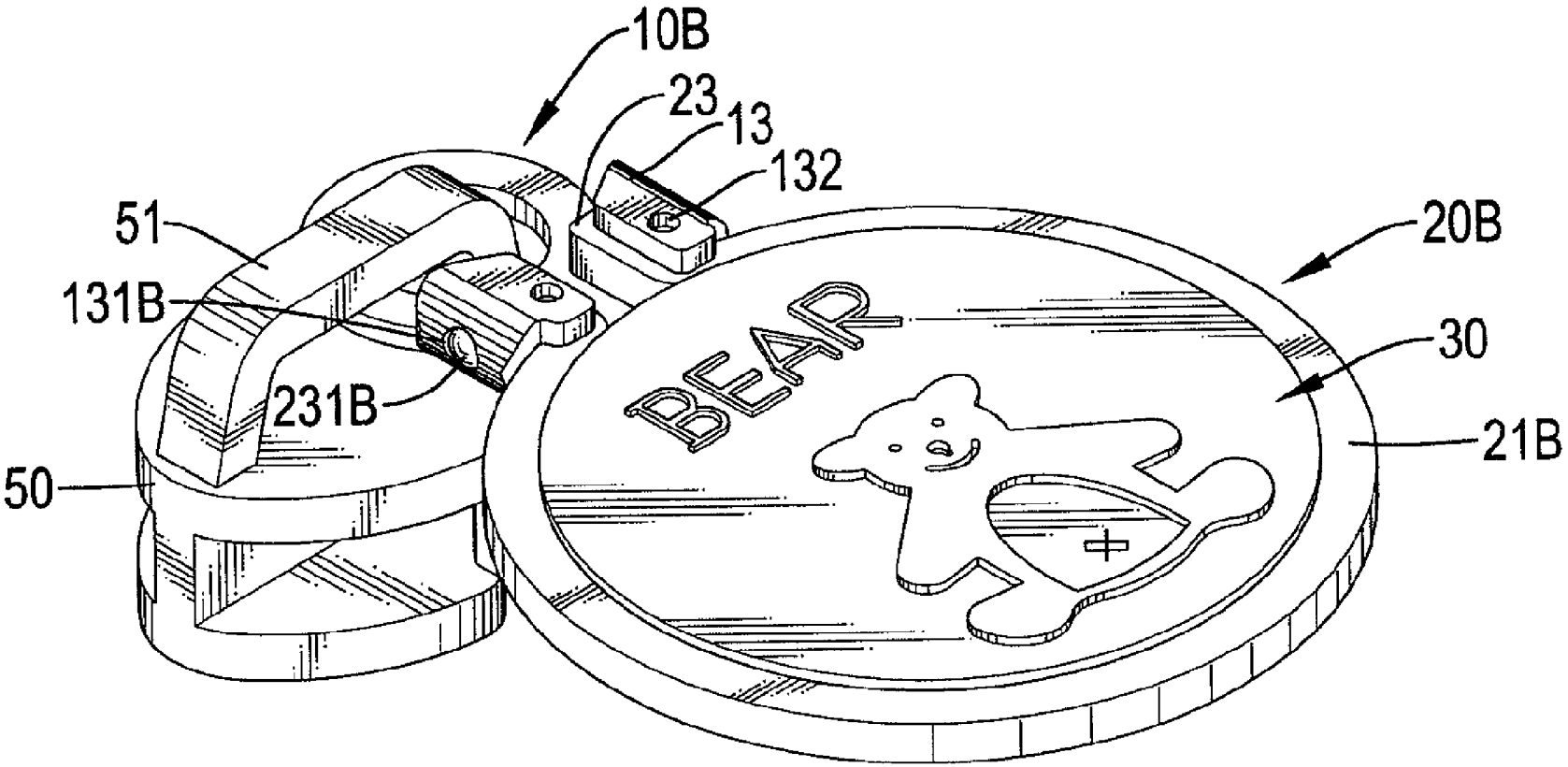
FIG. 5 is a perspective view of a zipper head with a third embodiment of a zipper tab assembly in accordance with the present invention.
Figure 6:
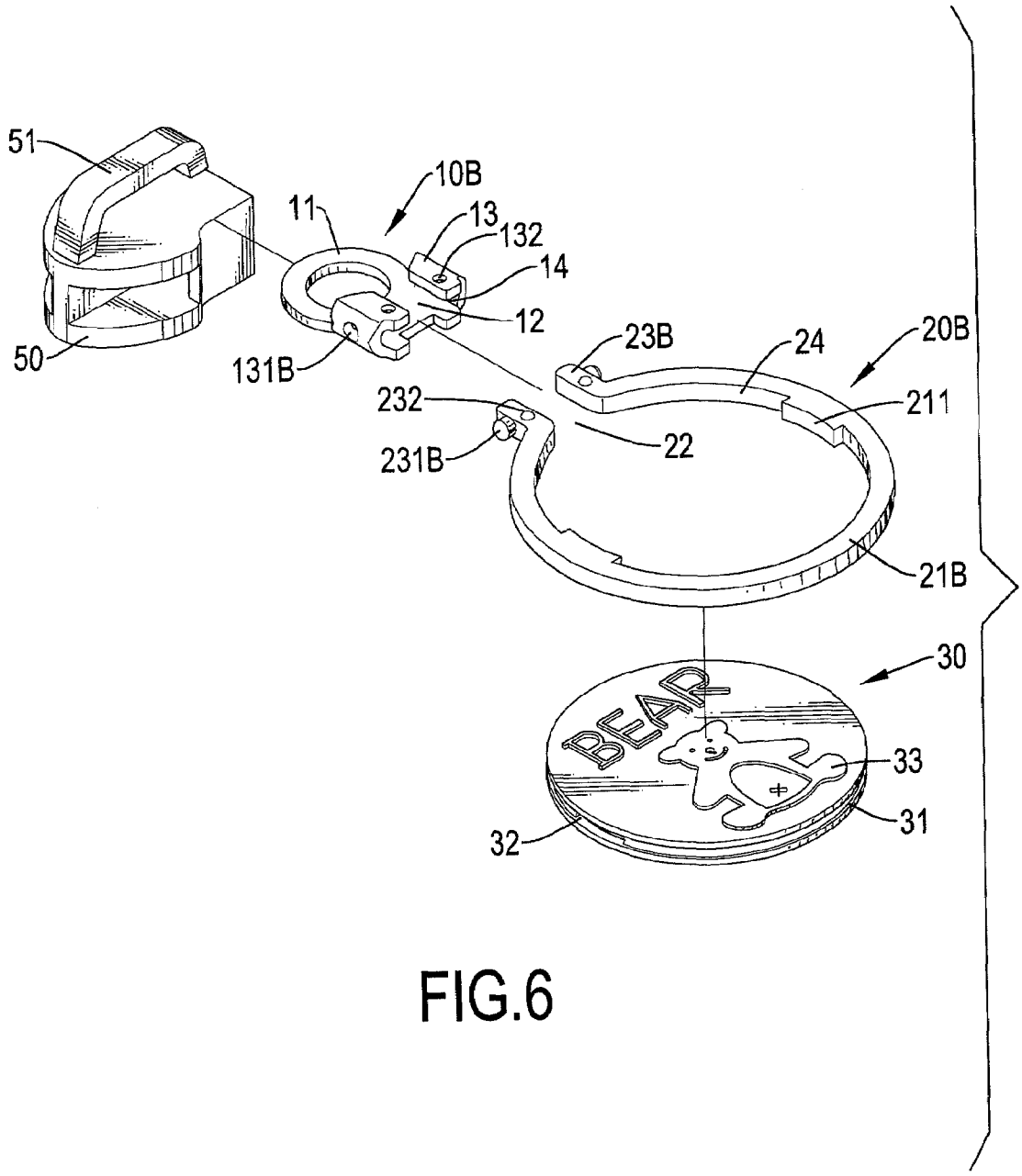
FIG. 6 is an exploded perspective view of the zipper head with the zipper tab assembly in FIG. 5.

With reference to FIGS. 5 and 6, in a third embodiment, the engaging holes (131B) in the connecting member (10B) are round holes, and the protrusions (231B) on the engaging ears (23B) of the resilient loop (31B) of the clamping member (20B) are cylindrical protrusions.

Figure 7:
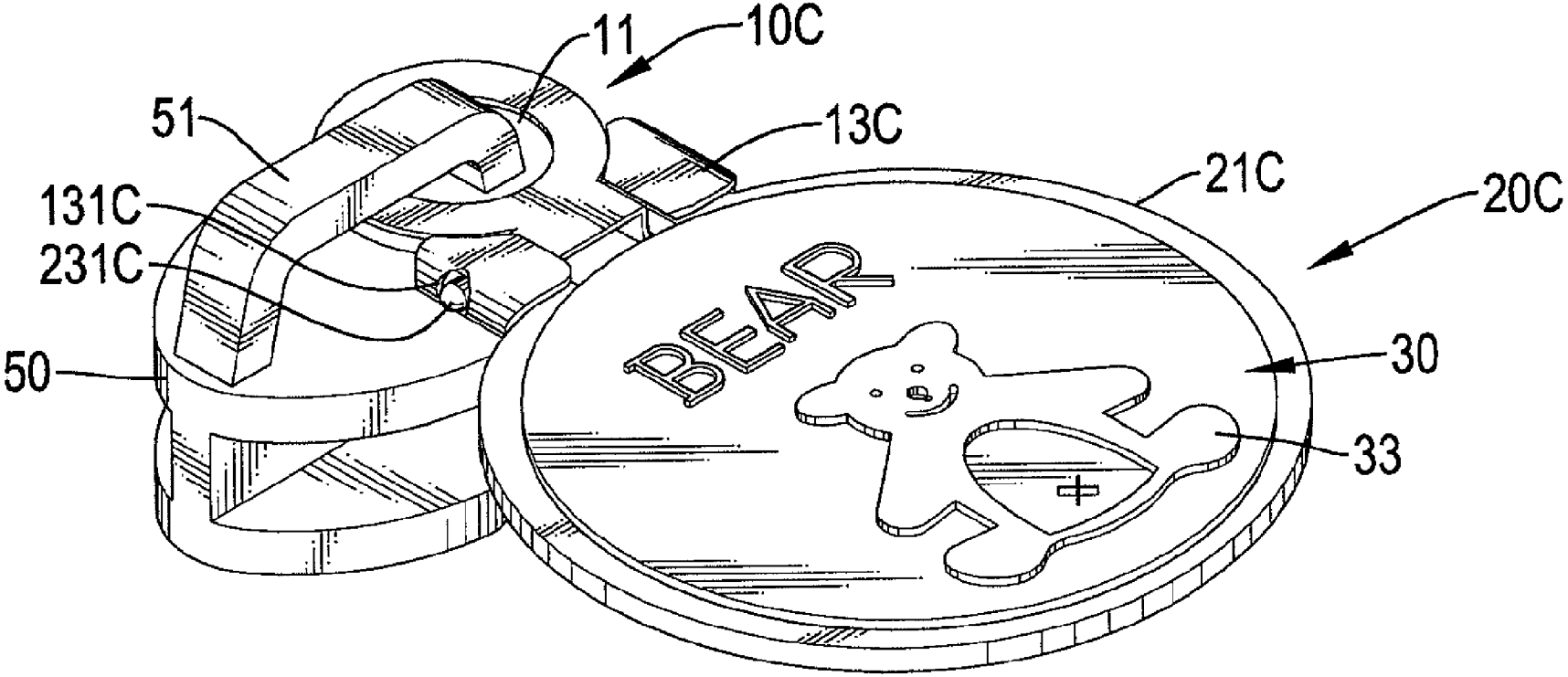
FIG. 7 is a perspective view of a zipper head with a fourth embodiment of a zipper tab assembly in accordance with the present invention.
Figure 8:
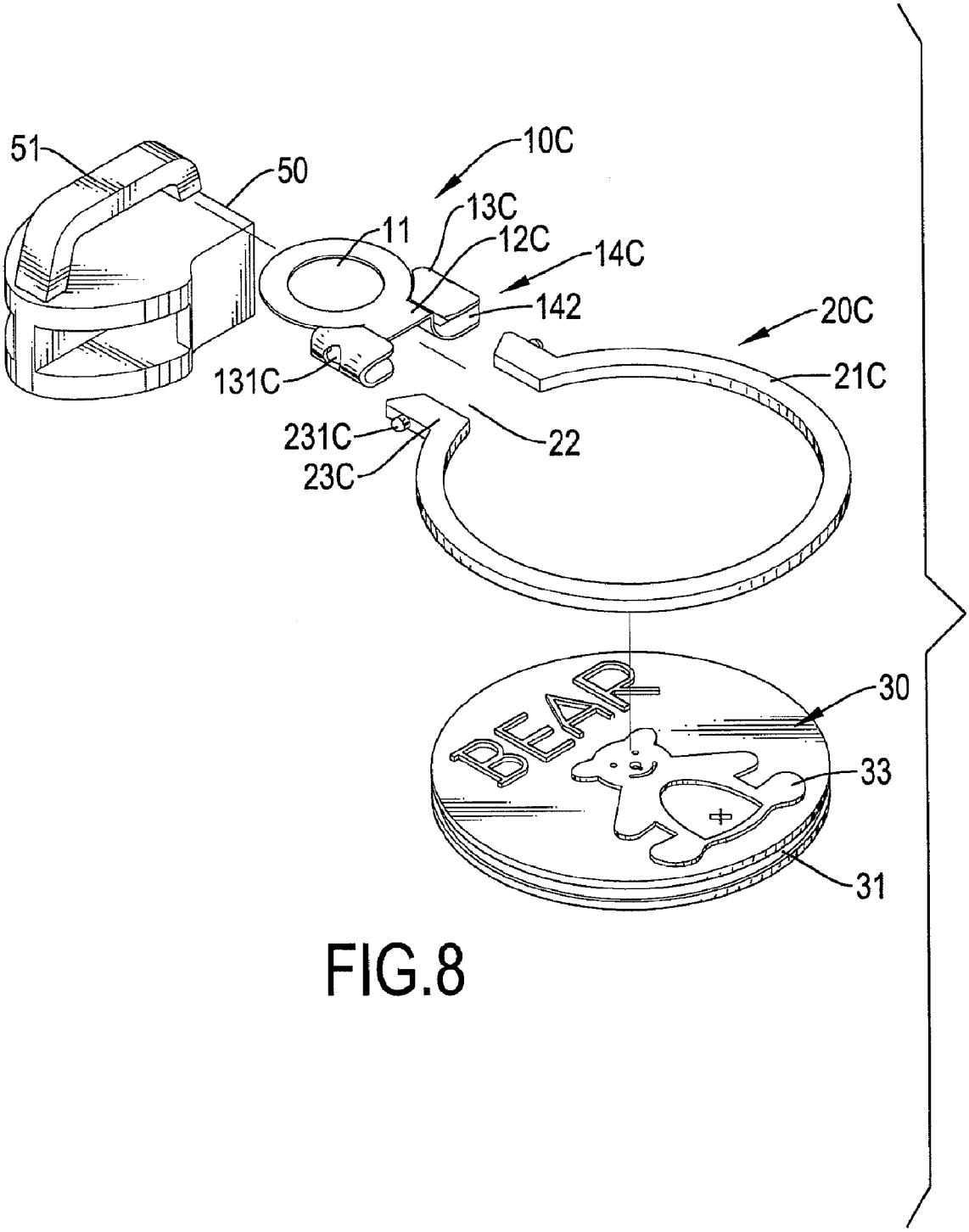
FIG. 8 is an exploded perspective view of the zipper head with the zipper tab assembly in FIG. 7.

With reference to FIGS. 7 and 8, the U-shaped flanges (13C) on the connecting portion (12C) of the connecting member (10C) are kept from communicating with each other to define two individual channel segments (142) of the engaging channel (14C). The engaging ears (23C) on the resilient loop (21C) of the clamping member (20C) are inserted respectively into the channel segments (142) of the engaging channel (14C), and the protrusions (231C) on the engaging ears (23C) engage respectively with the engaging holes (131C) in the connecting member (10C).

Figure 9:
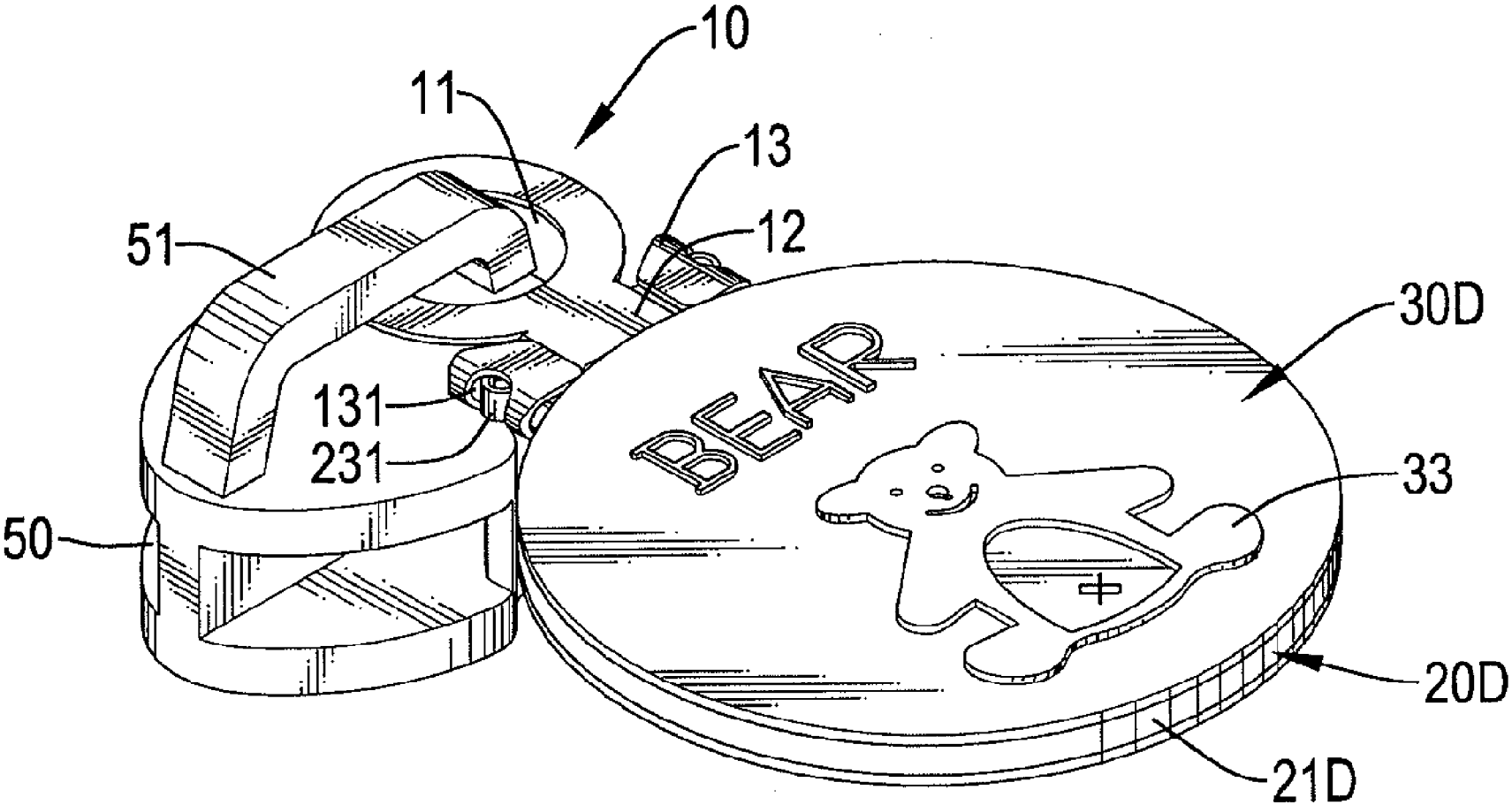
FIG. 9 is a perspective view of a zipper head with a fifth embodiment of a zipper tab assembly in accordance with the present invention.
Figure 10:
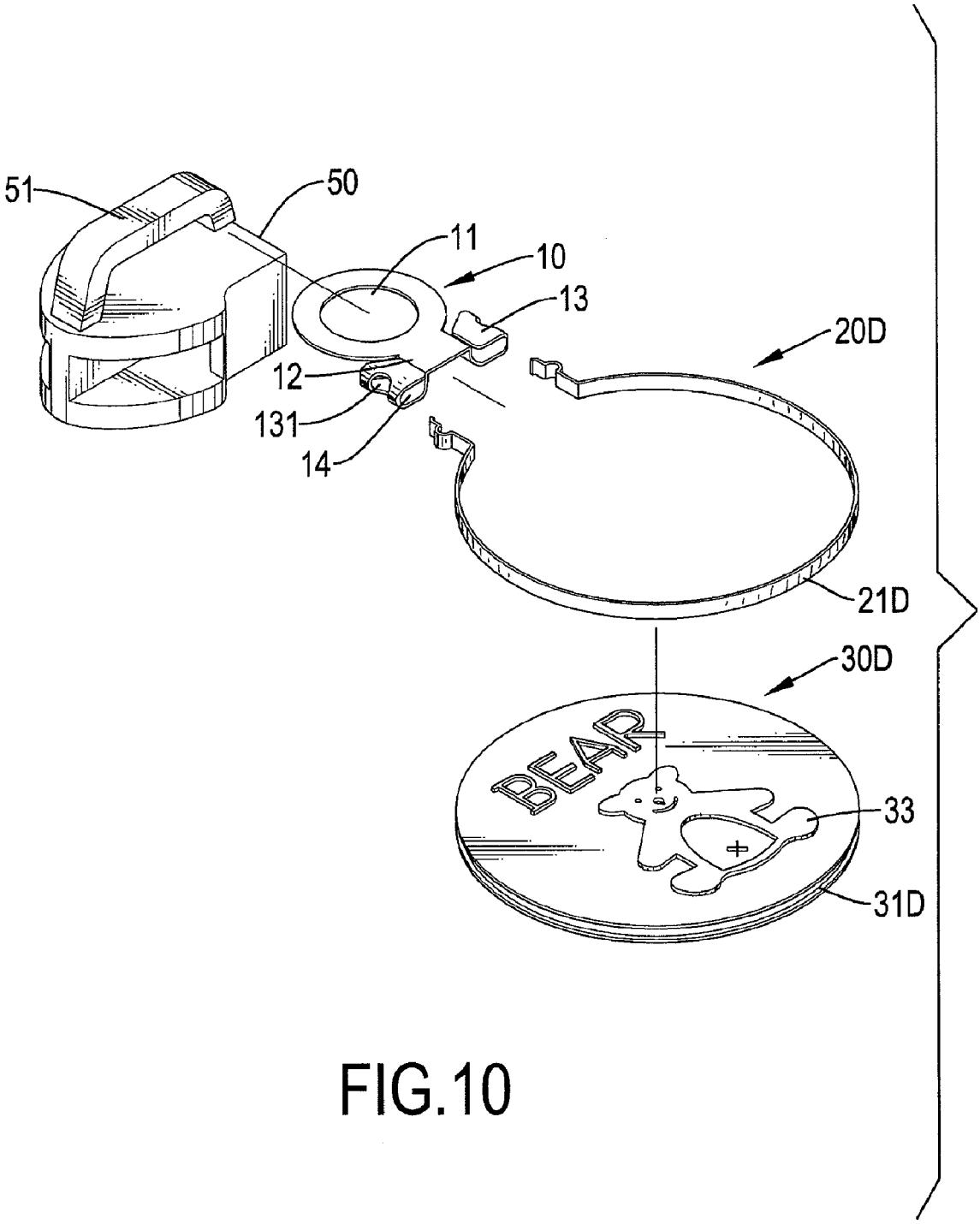
FIG. 10 is an exploded perspective view of the zipper head with the zipper tab assembly in FIG. 9.

With reference to FIGS. 9 and 10, in the fifth embodiment, the resilient loop (21D) of the clamping member (20D) is a circular strip held inside the annular groove (31D) in the decorative tab (30D).

Figure 11:
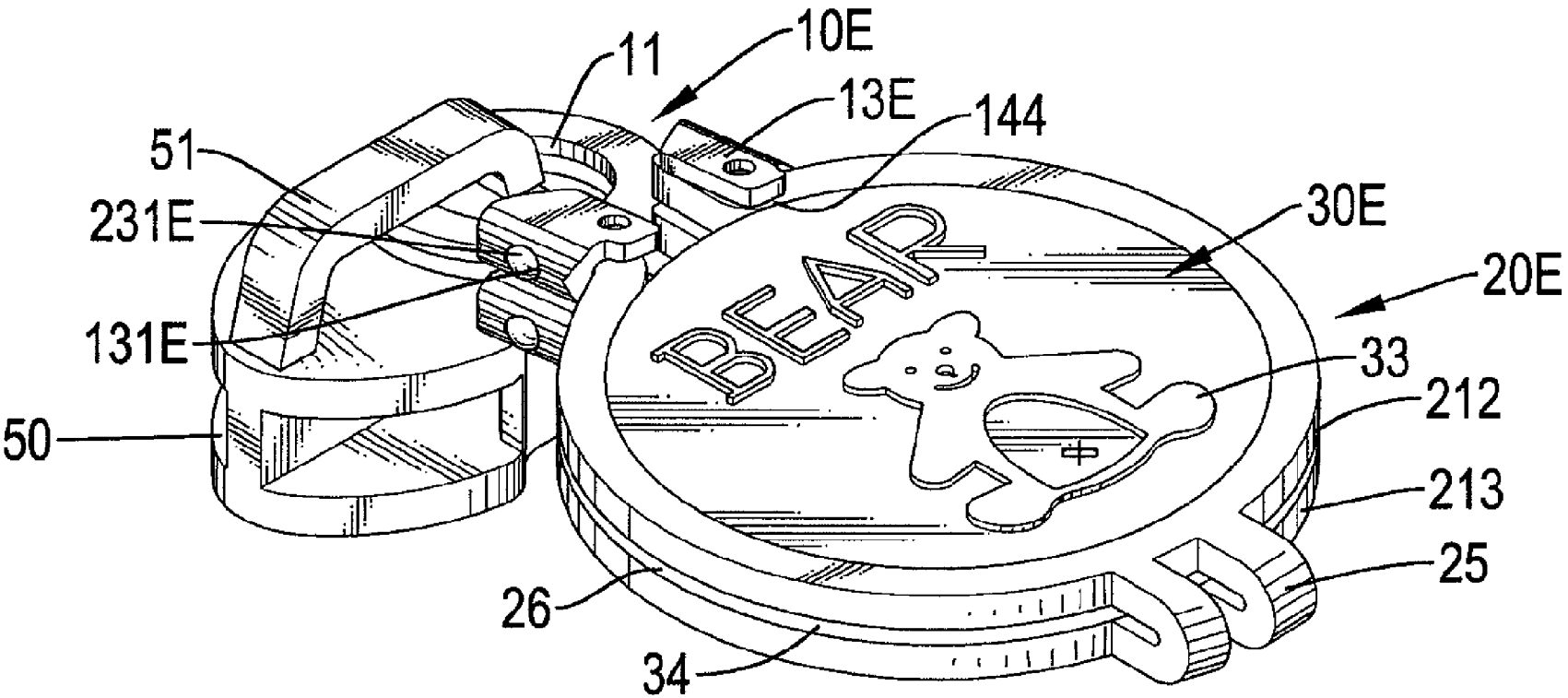
FIG. 11 is a perspective view of a zipper head with a sixth embodiment of a zipper tab assembly in accordance with the present invention.
Figure 12:
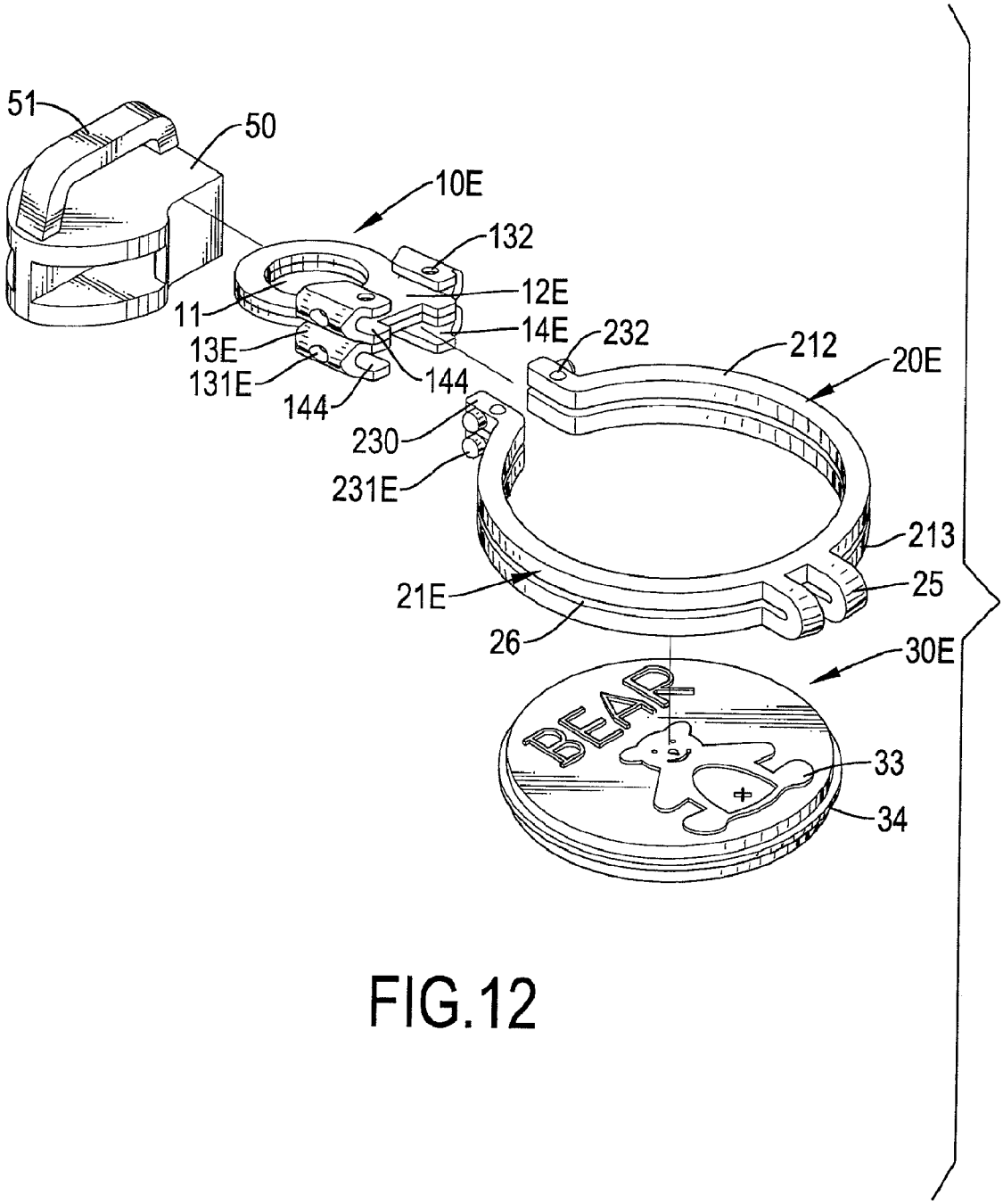
FIG. 12 is an exploded perspective view of the zipper head with the zipper tab assembly in FIG. 11.
Figure 13:
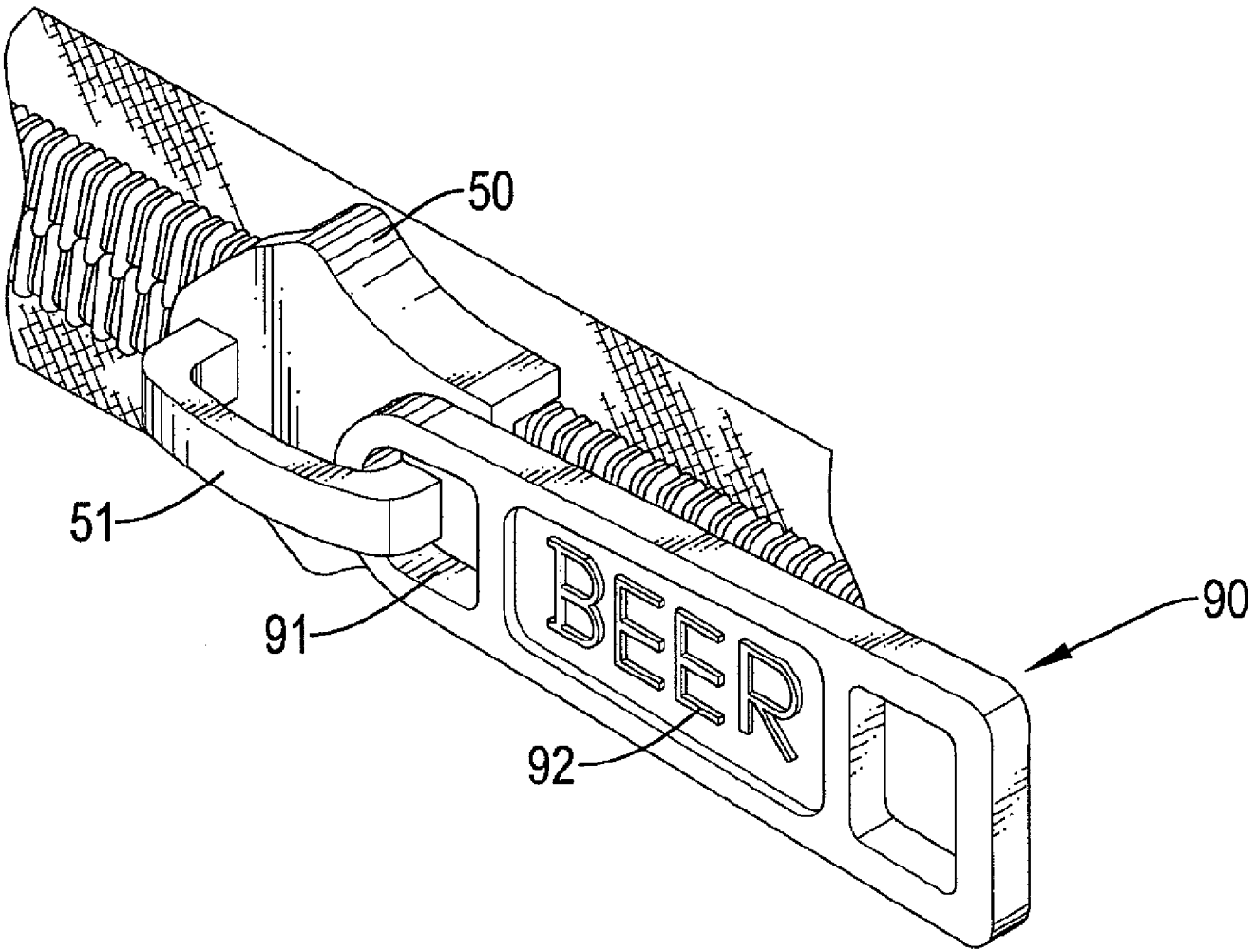
FIG. 13 PRIOR ART
FIG. 13 is a perspective view of zipper with a conventional zipper tab in accordance with the prior art.

With reference to FIGS. 11 and 12, in the sixth embodiment, the connecting member (10E) has two U-shaped flanges (13E) formed respectively on each side of connecting portion (12E) of the flat body and corresponding to each other. The engaging channel (14E) is defined between the U-shaped flanges (13E) and comprises two segments (144) formed respectively between corresponding U-shaped flanges (13E). Each flange (13E) has an engaging hole (131E) defined in the flange (13E).

The resilient loop (21E) of the clamping member (20E) is composed of two loop elements (212,213) connected with each other with a U-shaped connecting element (25) and axially align with and is separate to each other to define an annular clamping groove (26) between the loop elements (212,213). Each loop element (212,213) has two ear segments (230) detachably mounted in and engaging with a corresponding one of the segments (144) of the engaging channel (14). Each ear segment (230) has a protrusion (231E) engaging with the engaging hole (131E) in a corresponding flange (13E).

The decorative tab (30E) is mounted and clamped between the loop elements (212,213) of the resilient loop (21E) and has an annular rib (34) formed around the decorative tab (30E) and engaging with the clamping groove (26) between the loop elements (212,213) of the resilient loop (21E).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A zipper tab assembly comprising:

a connecting member having a through hole defined through the connecting member;

an engaging channel defined in the connecting member; and two engaging holes defined in two sides of the connecting member and communicating with the engaging channel;

a clamping member detachably attached to the connecting member and comprising a resilient loop having a clamping space and an opening communicating with the clamping space; and two engaging ears formed on the resilient loop at two sides of the opening, detachably mounted in the engaging channel in the connecting member and each having a protrusion extending into and engaging with one of the engaging holes in the connecting member; and a decorative tab mounted in and clamped inside the clamping space of the resilient loop.

2. The zipper tab assembly as claimed in claim 1, wherein the decorative tab has at least one pattern formed on the decorative tab.

3. The zipper tab assembly as claimed in claim 2, wherein the connecting member has a flat body with two sides and two U-shaped flanges formed respectively on two sides of the flat body and corresponding to each other;

the engaging channel is defined between the U-shaped flanges; and the engaging holes are defined respectively in the U-shaped flanges.

4. The zipper tab assembly as claimed in claim 3, wherein the decorative tab has an annular groove defined around the decorative tab and engaging with the resilient loop of the clamping member.

5. The zipper tab assembly as claimed in claim 4, wherein the resilient loop has at least one lug formed on and extending inward from an inner surface of the resilient loop; and the decorative tab has at least one recess defined in a periphery of the decorative tab and engaging respectively with the at least one lug on the resilient loop.

6. The zipper tab assembly as claimed in claim 5, wherein the resilient loop has two lugs formed on the inner surface of the resilient loop and located respectively at two opposite ends of a diameter of the resilient loop; and the decorative tab has two recesses engaging respectively with the lugs on the resilient loop.

7. The zipper tab assembly as claimed in claim 6, wherein each U-shaped flange on the connecting member has an orifice; and each engaging ear on the resilient loop of the clamping member has a knob engaging with the orifice in a corresponding one of the U-shaped flanges.

8. The zipper tab assembly as claimed in claim 7, wherein the protrusions on the engaging ears of the clamping member are convex protrusions.

9. The zipper tab assembly as claimed in claim 8, wherein the clamping space in the resilient loop is circular.

10. The zipper tab assembly as claimed in claim 8, wherein the clamping space in the resilient loop is elliptical.

11. The zipper tab assembly as claimed in claim 7, wherein the protrusions on the engaging ears of the clamping member are cylindrical protrusions.

12. The zipper tab assembly as claimed in claim 11, wherein the clamping space in the resilient loop is circular.

13. The zipper tab assembly as claimed in claim 11, wherein the clamping space in the resilient loop is elliptical.

14. The zipper tab assembly as claimed in claim 2, wherein the connecting member has two U-shaped flanges formed respectively on each side of the flat body and corresponding to each other;

the engaging channel is defined between the U-shaped flanges and comprising two segments formed respectively between corresponding U-shaped flanges;

the resilient loop is composed of two loop elements connected with each other with a U-shaped connecting element and axially aligning with and separate to each other to define an annular clamping groove between the loop elements;

each loop element has two ear segments detachably mounted in and engaging with a corresponding one of the segments of the engaging channel; and the decorative tab is mounted and clamped between the loop elements of the resilient loop.

15. The zipper tab assembly as claimed in claim 14, wherein the decorative tab has an annular rib formed around the decorative tab and engaging with the clamping groove between the loop elements of the resilient loop.

16. The zipper tab assembly as claimed in claim 1, wherein the connecting member has a flat body with two sides and two U-shaped flanges formed respectively on two sides of the flat body and corresponding to each other;

the engaging channel is defined between the U-shaped flanges; and the engaging holes are defined respectively in the U-shaped flanges.

17. The zipper tab assembly as claimed in claim 1, wherein the decorative tab has an annular groove defined around the decorative tab and engaging with the resilient loop of the clamping member.

18. The zipper tab assembly as claimed in claim 1, wherein the resilient loop has at least one lug formed on and extending inward from an inner surface of the resilient loop; and the decorative tab has at least one recess defined in a periphery of the decorative tab and engaging respectively with the at least one lug on the resilient loop.

19. The zipper tab assembly as claimed in claim 18, wherein the resilient loop has two lugs formed on the inner surface of the resilient loop and located respectively at two opposite ends of a diameter of the resilient loop; and the decorative tab has two recesses engaging respectively with the lugs on the resilient loop.

20. The zipper tab assembly as claimed in claim 1, wherein each U-shaped flange on the connecting member has an orifice; and each engaging ear on the resilient loop of the clamping member has a knob engaging with the orifice in a corresponding one of the U-shaped flanges.

* * * * *